US006153055A

United States Patent [19]

Crouse

[11] Patent Number: 6,153,055

[45] Date of Patent: Nov. 28, 2000

[54] APPARATUS FOR ASSISTING IN THE RELEASE OF A WEB

[75] Inventor: Jere W. Crouse, Beloit, Wis.

[73] Assignee: Beloit Technologies, Inc., Wilmington, Del.

[21] Appl. No.: 09/056,425

[22] Filed: Apr. 7, 1998

[51] Int. Cl.[7] ..... D21F 1/36

[52] U.S. Cl. ..... 162/193; 162/199; 162/272; 162/289; 162/358.1; 162/358.3; 162/358.5; 162/359.1; 15/256.5; 15/256.51; 100/102; 100/174

[58] Field of Search ..... 162/272, 306, 162/289, 358.1, 358.3, 358.5, 193, 199, 359.1; 15/256.5, 256.51; 100/174, 102; 34/422, 120, 85, 623

[56] References Cited

U.S. PATENT DOCUMENTS

| | | | |
|---|---|---|---|
| 2,951,053 | 8/1960 | Renter et al. | 260/28 |
| 4,111,746 | 9/1978 | Biondetti | 162/272 |
| 5,027,513 | 7/1991 | Allison, Jr. | 30/169 |
| 5,174,862 | 12/1992 | Hale et al. | 162/272 |
| 5,632,861 | 5/1997 | Crouse | 162/358.1 |
| 5,810,974 | 9/1998 | Laapotti | 162/358.5 |

OTHER PUBLICATIONS

Calkin, "Modern Pulp and Paper Making", 3rd edition, Reinhold Pub. Corp., 1957.

DuPont, Teflon Industrial Coatings, web page.

Calkin, Modern Pulp and Paper Making, Reinhold Pub. Co. p. 354, 1957.

*Primary Examiner*—Peter Chin

*Attorney, Agent, or Firm*—Lathrop & Clark LLP

[57] ABSTRACT

An apparatus is disclosed for assisting in the release of a web from contact with the heated surface. The apparatus includes a material which is urged into contact with the heated surface upstream relative to the contact of the web to the heated surface. The material is devoid of metallic content and the arrangement is such that when the web contacts the heated surface downstream relative to the material, thermal energy is transferred from the surface to the web. The web is released from the heated surface subsequent to the transfer of the heat, such release being facilitated by the material being urged against the surface.

9 Claims, 2 Drawing Sheets

APPARATUS FOR ASSISTING IN THE RELEASE OF A WEB

BACKGROUND OF THE INVENTION

Field of the Invention

The present invention relates to an apparatus for assisting in the release of a web from contact with a heated surface.

More specifically, the present invention relates to an apparatus for releasing a web from a surface such as a backing roll of a heated extended nip press or a heated surface of a dryer.

INFORMATION DISCLOSURE STATEMENT

In a heated extended nip press, thermal energy is supplied to the surface of a backing roll so that when a formed web travels between the heated surface of the backing roll and a cooperating press shoe, thermal energy is imparted to the web for driving therefrom as much water as possible.

However, in the aforementioned heated extended nip arrangements known in the art as high temperature presses (HTP), there has been a tendency for the web to stick to the heated surface of the backing roll when the web exits the pressing section. Such sticking of the web can cause delamination of the web or at least cause picking of fibers from the surface of the web on the backing roll side thereof.

Many compositions have been applied to the surface of the aforementioned backing rolls in an attempt to enhance the release characteristics of the backing roll and to minimize picking of fibers from the pressed web. Applicant has made the surprising discovery that by wiping the heated surface of the backing roll with a non-metallic material such as TEFLON or the like, upstream relative to the pressing section, release of the web from the heated surface subsequent to the pressing section is remarkably improved.

Therefore it is a primary objective of the present invention to provide an apparatus for assisting in the release of a web such apparatus overcoming the problems associated with prior art arrangements.

Other objects and advantages of the present invention will be readily apparent to those skilled in the art by consideration of the detailed description contained hereinafter taken in conjunction with the annexed drawings.

SUMMARY OF THE INVENTION

The present invention relates to an apparatus for assisting in the release of a web from contact with a heated surface. The apparatus includes a material which is urged into contact with the heated surface upstream relative to the contact of the web with the heated surface. The material is devoid of metallic content and the arrangement is such that when the web contacts the heated surface downstream relative to the material, thermal energy is transferred from the surface to the web.

Subsequent to the transfer of heat, release of the web from the heated surface is facilitated by the provision of the material being urged against the surface.

Many modifications and variations of the present invention will be readily apparent to those skilled in the art by consideration of the detailed description contained hereinafter taken in conjunction with the annexed drawings.

However, such modifications and variations fall within the spirit and scope of the present invention as defined by the appended claims.

BRIEF DESCRIPTION OF THE DRAWINGS

Similar reference characters refer to similar parts throughout the various figures of the drawings.

DETAILED DESCRIPTION OF THE DRAWINGS

Figure 1:
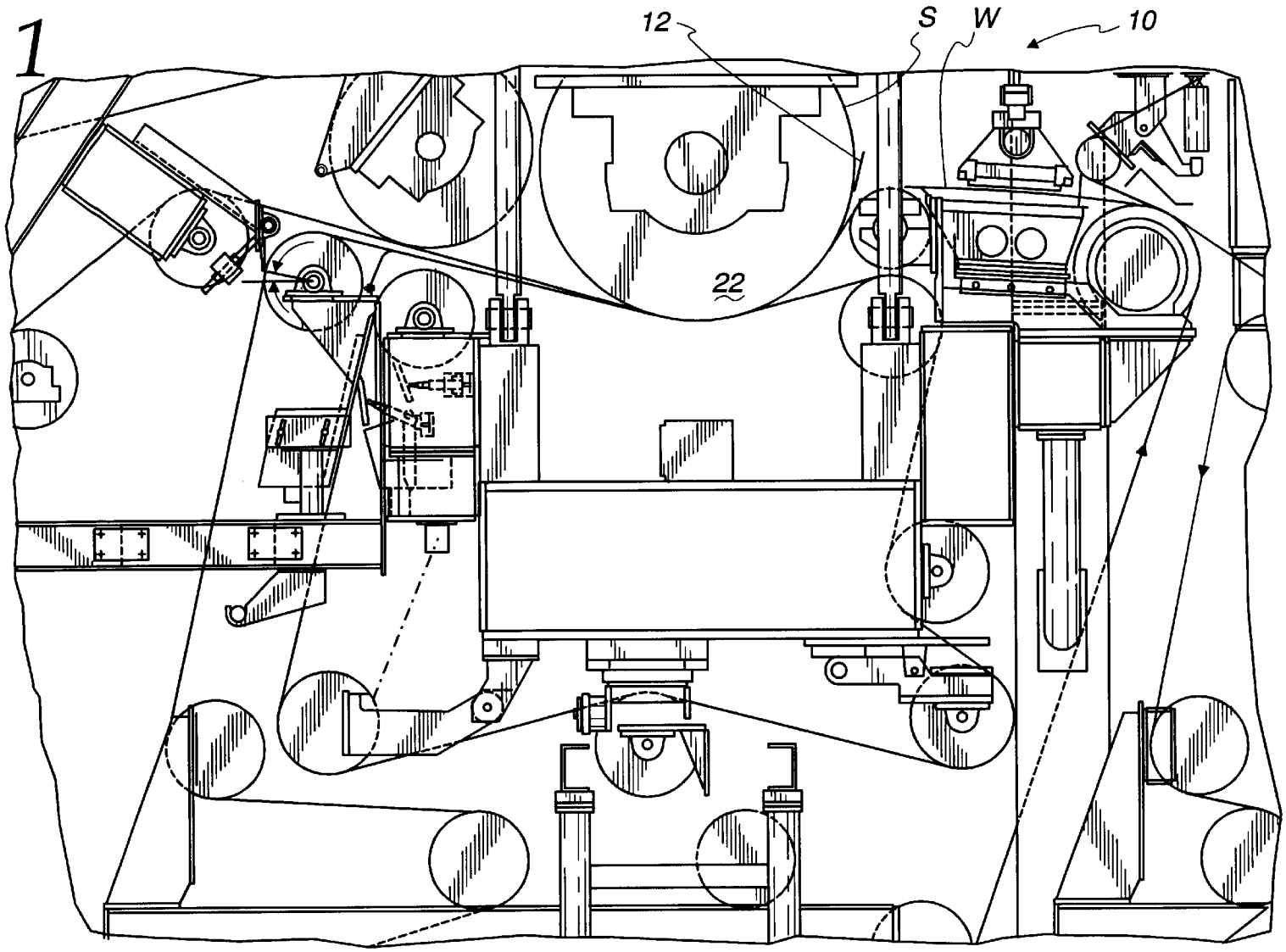
FIG. 1 is a side elevational view of a heated extended nip press apparatus including the apparatus according to the present invention.
Figure 2:
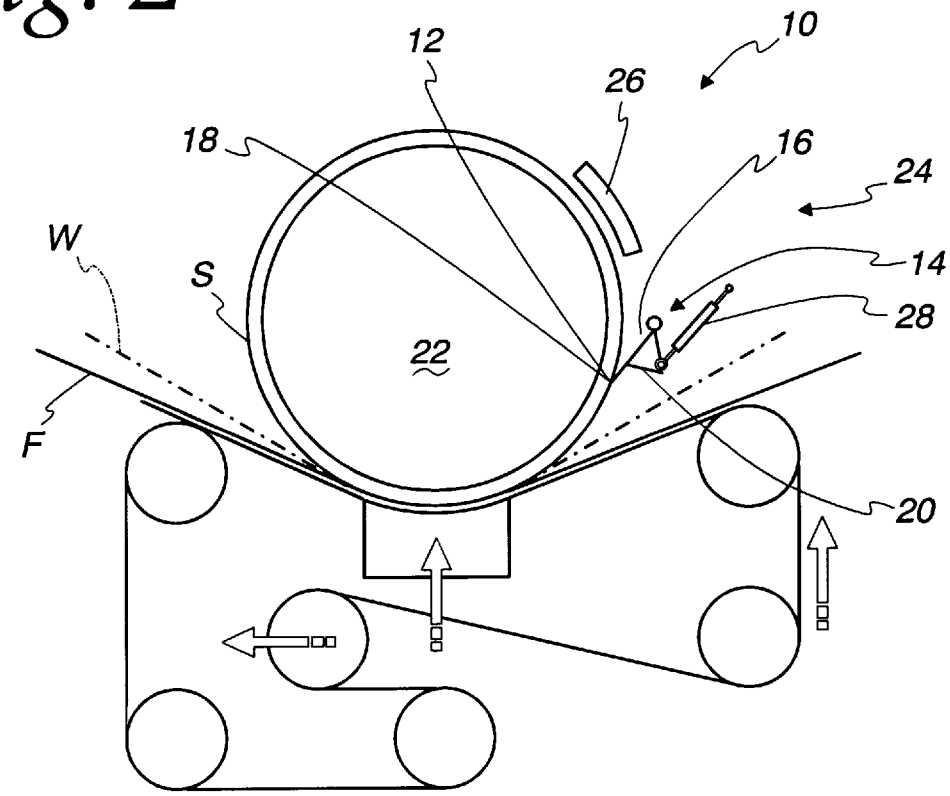
FIG. 2 is an enlarged side elevational view of a backing roll of the heated extended nip press shown in FIG. 1 showing the material urged into contact with the heated surface of the backing roll.

FIGS. 1 and 2 are side elevational views of an apparatus generally designated 10 according to the present invention for assisting in the release of a web W from contact with a heated surface S. The apparatus 10 includes a material 12 urged into contact with the heated surface S upstream relative to the contact of the web W with the heated surface S. The material 12 is devoid of metallic content and the arrangement is such that when the web W contacts the heated surface S downstream relative to the material 12, thermal energy is transferred from the surface S to the web W.

Subsequent to the transfer of heat, release of the web W from the heated surface S is facilitated by the material 12 being urged against the surface S.

In a more specific embodiment of the present invention as shown in FIG. 2, the material is TEFLON.

Alternatively, the material includes molybdenum disulfide.

As shown in FIG. 2, the apparatus includes a blade generally designated 16 having a proximal and a distal end 16 and 18, respectively. The distal end 18 includes the material 12 which is urged into surface contact with the heated surface S.

More specifically, the apparatus 10 includes a backing plate 20 which is secured to the proximal end 16 of the blade 14 for imparting rigidity to the blade 14 and for permitting urging of the distal end 18 of the blade 14 against the heated surface S.

As shown in FIG. 2, the apparatus 10 includes a trailing doctor which has a distal end 18 fabricated from the material 12 so that the material 12 wipes the heated surface S prior to the surface S coming into contact with the web W.

More specifically, the apparatus 10 includes a rotatable roll 22 having a peripheral surface S which is heated by for example, an induction heater 26. The roll 22 is a backing roll of a heated extended nip press generally designated 24.

The heated surface has a composition which includes ARMACOR or a ceramic or CHROMEX or a combination of such materials or ARMACOR, ceramic and CHROMEX in combination with other ingredients.

Figure 3:
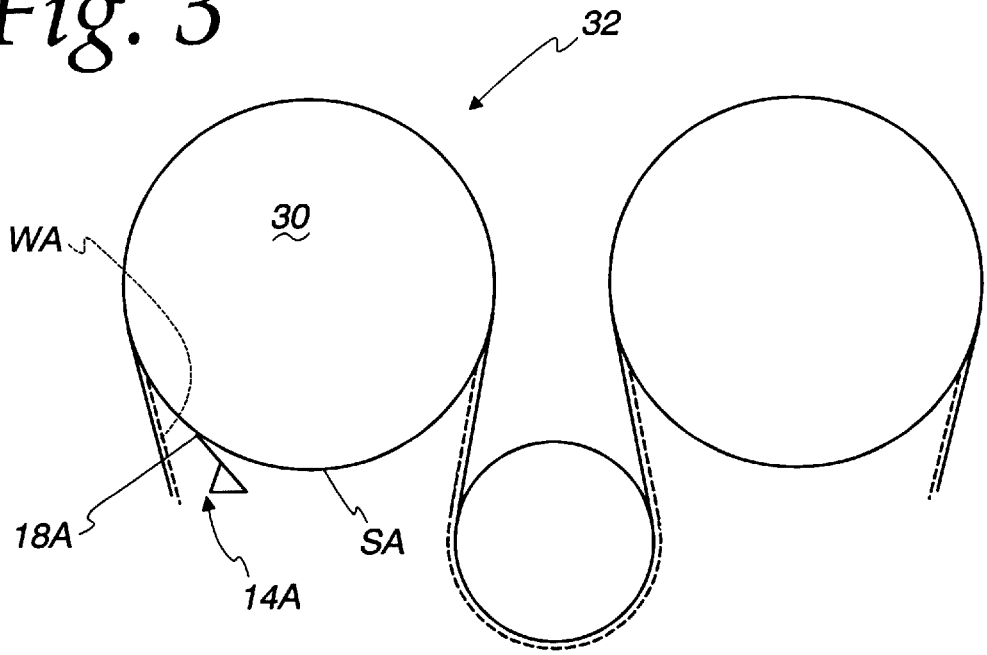
FIG. 3 is a side elevational view showing an alternative embodiment of the present invention in which the apparatus includes a material urged into contact with the heated surface of a dryer cylinder.

FIG. 3 is a side elevational view of an alternative embodiment of the present invention wherein the apparatus further includes a dryer 30 of a dryer section generally designated 32 and in which the dryer defines the heated surface SA.

A blade 14A is urged against the surface SA. The distal end 18A of the blade 14A is of TEFLON or the like material.

As shown in FIG. 2, the wiping blade 14 further includes means 28 for selectively urging the material 12 against the heated surface S for predictably controlling the release characteristics of the heated surface S.

More specifically, when the means 28 urges the material 12 against the heated surface S, the web W is readily released from the heated surface S downstream relative to the pressing thereof. However, when the means 28 withdraws the material 12 from contact with the heated surface S, the web W follows or sticks to the heated surface S. Consequently, by selectively controlling the released characteristics of the heated surface S, threading of the press section 24 is facilitated.

Applicant has also discovered that when the material is urged against the side of a press felt F extending through the heated extended nip press section, and coming into surface contact with the web, release of the web from the felt is facilitated.

Additionally, Applicant has observed that although the material such as TEFLON is urged against the heated surface of the backing roll or dryer cylinder, hardly any Teflon is taken up by the heated surface.

The present invention greatly assists in the release of a web from contact with a heated surface of a backing roll in a press section or the heated surface of a dryer cylinder.

What is claimed is:

1. An apparatus for assisting in the release of a paper web from contact with a heated roll surface, said apparatus comprising:

a trailing doctor blade urged into wiping contact with the heated roll surface upstream relative to the contact of the web with the heated roll surface; and means for selectively urging said trailing doctor blade into wiping contact with said heated roll surface;

said trailing doctor blade fabricated of a material being devoid of metallic or abrasive content having a web releasing property when wiped on said heated roll surface, the arrangement being such that when the web contacts the heated roll surface downstream relative to said material, thermal energy is transferred from the heated roll surface to the web; and release of the web from the heated roll surface subsequent to the transfer of heat being facilitated by said material being urged against the heated roll surface.

2. An apparatus as set forth in claim 1 wherein said material includes:

molybdenum disulfide.

3. An apparatus as set forth in claim 1 wherein the trailing doctor blade has a proximal and a distal end, said distal end including said material.

4. An apparatus as set forth in claim 3 further including:

a backing plate which is secured to said proximal end of said blade for imparting rigidity to said blade and for permitting urging of said distal end of said blade against the heated roll surface.

5. An apparatus as set forth in claim 1 wherein:

the trailing doctor blade has a distal end fabricated from said material so that said material wipes the heated roll surface.

6. An apparatus as set forth in claim 1 wherein said roll is a backing roll of a heated extended nip press.

7. An apparatus as set forth in claim 6 wherein said roll surface has a composition which includes:

a ceramic.

8. An apparatus as set forth in claim 1 wherein said heated roll is a dryer of a dryer section.

9. A method for selectively controlling the release characteristics of a heated roll surface in a press section for a paper web, the method comprising:

selectively urging a trailing doctor blade fabricated of a non-abrasive and non-metallic material into wiping contact with the heated roll surface between a contact position and a withdrawn position said material having web release property when wiped on said heated roll surface;

threading a paper web through the press section when the non-abrasive and non-metallic material is in the withdrawn position relative to the heated roll surface; and releasing the paper web from the heated roll surface when the non-abrasive and non-metallic material is in contact with the heated roll surface, wherein the step of selectively urging the non-abrasive and non-metallic material into contact with the heated roll surface includes:

selectively urging a non-abrasive and non-metallic material into wiping contact with the heated roll surface to facilitate threading of the paper web.

* * * * *